US010526782B1

(12) United States Patent
Johnson

(10) Patent No.: US 10,526,782 B1
(45) Date of Patent: Jan. 7, 2020

(54) MOBILE CARRIAGE FOR ACOUSTIC PANELS

(71) Applicant: L.J. Avalon, LLC., Tampa, FL (US)

(72) Inventor: Lahnie Johnson, Tampa, FL (US)

(73) Assignee: LJ Avalon LLC, Tampa, FL (US)

( * ) Notice: Subject to any disclaimer, the term of this patent is extended or adjusted under 35 U.S.C. 154(b) by 337 days.

(21) Appl. No.: 15/620,944

(22) Filed: Jun. 13, 2017

Related U.S. Application Data

(60) Provisional application No. 62/351,221, filed on Jun. 16, 2016.

(51) Int. Cl.

| | |
|---|---|
| ***E04B 1/84*** | (2006.01) |
| ***E04B 1/86*** | (2006.01) |
| ***E04F 19/06*** | (2006.01) |
| ***E04B 1/82*** | (2006.01) |
| ***E04B 2/74*** | (2006.01) |

(52) U.S. Cl.
CPC ..... *E04B 1/8409* (2013.01); *E04B 1/86* (2013.01); *E04F 19/06* (2013.01); *E04B 2001/8263* (2013.01); *E04B 2001/8423* (2013.01); *E04B 2001/8457* (2013.01); *E04B 2002/7479* (2013.01)

(58) Field of Classification Search
CPC ..... E04F 19/06; E04B 2001/8263; E04B 2001/8423; E04B 2001/8457; E04B 1/8409; E04B 1/86; E04B 2002/7479
USPC ..... 181/30, 287; 160/135
See application file for complete search history.

(56) References Cited

U.S. PATENT DOCUMENTS

| | | | | |
|---|---|---|---|---|
| 2,495,636 | A | | 1/1950 | Hoeltzel et al. |
| 2,497,912 | A | | 2/1950 | Rees |
| 2,553,363 | A | | 5/1951 | Droeger |
| 2,694,025 | A | | 11/1954 | Slayter et al. |
| 2,923,372 | A | | 2/1960 | Maccaferri |
| 3,017,969 | A | * | 1/1962 | Nielsen ..... E04B 2/7425 52/239 |
| 3,136,397 | A | | 6/1964 | Eckel |
| 3,232,370 | A | * | 2/1966 | Jaffe ..... G10K 11/20 181/30 |
| 3,630,309 | A | * | 12/1971 | Wenger ..... E04B 1/8236 181/30 |
| 3,674,081 | A | * | 7/1972 | List ..... E06B 9/063 160/161 |
| 3,949,827 | A | | 4/1976 | Witherspoon |
| 3,967,693 | A | | 7/1976 | Okawa |
| 4,113,053 | A | | 9/1978 | Matsumoto et al. |
| 4,160,491 | A | | 7/1979 | Matsumoto et al. |
| 4,207,964 | A | | 6/1980 | Taguchi |
| 4,248,325 | A | | 2/1981 | Georgopoulos |
| 4,306,631 | A | | 12/1981 | Reusser |
| 4,402,384 | A | | 9/1983 | Smith et al. |
| 4,605,090 | A | | 8/1986 | Melfi |
| 4,607,466 | A | | 8/1986 | Allred |
| 4,805,734 | A | | 2/1989 | Mast |

(Continued)

*Primary Examiner* — Jeremy A Luks
(74) *Attorney, Agent, or Firm* — Frijouf, Rust & Pyle, P.A.

(57) ABSTRACT

A carriage is disclosed for moveably supporting an acoustical panel. The carriage comprises a frame having rolling members for movably for supporting the acoustical panel. A first and a second pair of support legs extend angularly from the frame for enabling a plurality of carriages to orientate acoustical panels in a linear or angular relationship. Each of the unique acoustical panels provides sound absorption as well inhibiting sound transmission.

14 Claims, 7 Drawing Sheets

(56) References Cited

U.S. PATENT DOCUMENTS

| | | | | |
|---|---|---|---|---|
| 4,834,213 | A | 5/1989 | Yamamoto et al. | |
| 5,217,771 | A | 6/1993 | Schmanski et al. | |
| 5,272,284 | A | 12/1993 | Schmanski | |
| 5,403,979 | A * | 4/1995 | Rogers | E04B 1/8236 181/287 |
| 5,651,405 | A * | 7/1997 | Boeddeker | E04B 1/8236 160/135 |
| 6,085,861 | A * | 7/2000 | Jines | G10K 11/20 181/198 |
| 6,598,649 | B1 * | 7/2003 | Moore | E04B 2/7431 160/135 |
| 7,063,184 | B1 | 6/2006 | Johnson | |
| 7,213,632 | B1 * | 5/2007 | Goldstein | A47G 5/00 160/135 |
| 7,503,428 | B1 | 3/2009 | Johnson | |
| 7,513,082 | B2 | 4/2009 | Johnson | |
| 7,584,776 | B2 * | 9/2009 | Hardt, II | E04B 2/7427 160/135 |
| 7,735,537 | B2 * | 6/2010 | Hardt, II | E04B 2/7427 16/44 |
| 8,739,924 | B2 | 6/2014 | Johnson | |
| 8,893,762 | B2 * | 11/2014 | Ryan | E04B 2/7425 160/135 |
| 2008/0040982 | A1 * | 2/2008 | Durand | A47B 9/14 52/36.1 |
| 2010/0051211 | A1 * | 3/2010 | Chen | E04B 2/7427 160/135 |
| 2012/0152468 | A1 * | 6/2012 | Melhart | G10K 11/20 160/120 |

* cited by examiner

MOBILE CARRIAGE FOR ACOUSTIC PANELS

CROSS-REFERENCE TO RELATED APPLICATIONS

This application claims benefit of U.S. Patent Provisional application No. 62/351,221 filed Jun. 16, 2016. All subject matter set forth in provisional application No. 62/351,221 is hereby incorporated by reference into the present application as if fully set forth herein.

BACKGROUND OF THE INVENTION

Field of the Invention

This invention relates to sound control and more particularly to a mobile carriage for acoustic panel.

Description of the Related Art

The prior art has known various types of devices and methods for reducing the level of sound within an environment. The various types of devices and methods of the prior art for reducing the level of sound within an environment included a diverse and variety of apparatuses and methods adapted for many as specific applications and uses.

One particular type of device for reducing the level of sound within an environment comprises the use of sound reducing panels and/or sound absorbing devices. Various types of sound reducing panels and sound absorbing devices have been incorporated by the prior art to reduce the level of sound and/or to selectively reduce or inhibit reflection of sound from reflective surfaces within an environment.

In some instances, the apparatuses and methods for reducing the level of sound within an environment selectively reduced the level of sound within an environment. Many of the apparatuses and methods for reducing the level of sound within an environment were specifically designed for providing enhancements for improving the acoustics within the environment. Sound reducing panels and sound absorbing devices have been employed in very large rooms such as auditoriums as well as smaller rooms such as recording studios, home theaters and the like.

Other apparatuses and methods for reducing the level of sound within an environment of the prior art reduce the overall level of acoustic noise and/or sound and/or noise within the environment. In many cases, sound absorbing apparatuses and methods were used to reduce the sound of operating machinery as well as being used for reducing the transmission of sound and/or noise between the adjacent walls of a building.

The following U.S. Patents are representative of the attempts of the prior an to provide apparatuses and devices for reducing sound within an environment.

U.S. Pat. No. 2,495,636 to O. R. Hoeltzel et al. discloses a unit comprising a layer of loosely matted mass of fibrous material. A substantially impervious preformed and film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to W. M. Rees discloses an acoustic construction for the walls and ceilings of an enclosure comprising a sound absorbing layer overlying the wall and formed by a plurality of rectangles or tiles of fibrous material arranged in a plane. The edge of each of the tiles is contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to C. C. Droeger discloses a non-combustible wall or ceiling of a plurality of parallel, latterly spaced, non-combustible primary furrings anchored thereon. Sound absorbent pads are arranged between adjacent pairs of furrings. A plurality of spaced, non-combustible secondary furrings extend extended transversely across the primary furrings and are secured thereto. Each of the secondary furrings comprise a portion lying in a plane parallel with the wall or ceiling and bridging between primary furrings and are provided with a multiplicity of perforations adapted to threadably receive threaded shanks of screws. A multi-perforate finish sheaths overlies the aforesaid parts.

U.S. Pat. No. 2,694,025 to G. Slayter et al. discloses a structural board comprising a core of glass fibers bounded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to M. Maccaferri discloses an all plastic acoustic tile formed of a molded plastic material comprising a plate-like body having a rearwardly extending edge flange thereabout integral therewith. The body is formed to provide the front side thereof as a flat, planar face and having a multiplicity of apertures therethrough from the front face to and opening through the rear side all the body. Sound wave dampening tubes are molded integrally with the body projecting rearwardly from the rear side thereof. Each of the dampening tubes has a passage therethrough opening at the rear end thereof. Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 3,136,397 to O. C. Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities being opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cubic centimeters by bulk volume of formed perlite particles each having a diameter of 0.1 to 7.0 millimeters 100 to 140 grams of cement, liquid rubber latex containing 5 to 20 grams of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Allred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound, the device being fabricated of polymer composition and comprising a hollow core member formed of fiber-reinforced thermosetting resin, and at least an outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

In my prior invention set forth in U.S. Pat. No. 7,063,184, I disclosed an apparatus and method of making an improved sound reducing panel suitable for use in an outdoor or a hazardous environment. The improved sound reducing panel comprises a water resistant sound absorbing member with a porous covering sheet overlaying a face surface of the sound absorbing member. A support frame is disposed about an outer perimeter of the sound absorbing member. An attachment secures the improved sound reducing panel to the support frame. In one embodiment, a sound blocking member is located adjacent to the sound absorbing member.

In another prior invention set forth in U.S. Pat. No. 7,503,428, I disclosed an apparatus and method for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

In still another prior invention set forth in U.S. Pat. No. 7,513,082, I disclosed a system for reducing the transmission of acoustical energy between a first and second wall surface of a wall comprising a first and a second beam for supporting a sound panel. Each of the first and second beams comprises first and second flanges interconnected by an inner connector with a fold defined in the inner connector for reducing the transmission of acoustical energy between the first and second flange. The fold cooperates with one of the flanges for defining a pocket for receiving an edge of a sound panel. The first and second flange support the first and second wall surface of the wall with the sound panel.

In still further prior invention set forth in U.S. Pat. No. 8,739,924, I disclosed an apparatus and method for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

It is an object of the present invention to continue to improve upon my prior inventions by providing a mobile carriage for an acoustic panel.

Another object of this invention is to provide a mobile carriage for an acoustic panel for facilitating the movement of large acoustic panels.

Another object of this invention is to provide a mobile carriage for an acoustic panel for interlocking a plurality of mobile carriages and acoustic panels.

Another object of this invention is to provide a mobile carriage for an acoustic panel that accommodates existing acoustic panels.

Another object of this invention is to provide a mobile carriage for an acoustic panel that is capable of mounting adjacent acoustic panels at an angle of ninety degrees.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a carriage for moveably supporting an acoustical panel on a surface. The carriage comprises frame having rolling members for movably supporting the acoustical panel. A first and a second pair of support legs extend angularly from the frame for enabling a plurality of carriages to orientate acoustical panels in a linear or angular relationship.

In a more specific example of the invention, the acoustical panel has a panel frame extending about a perimeter of the acoustical panel for defining an acoustical aperture to receiving and dissipating acoustical energy. The carriage comprises a frame having a horizontal support and a vertical support extending between a first and a second end of the frame. The frame has a generally major U-shape frame having a horizontal support and a plurality of vertical supports. The frame comprises a generally major U-shape frame having horizontal support and a plurality of the vertical supports for receiving portion of the acoustical panel. The plurality of fasteners secure the panel frame of the acoustical panel to the plurality vertical supports of the frame.

Preferably, the frame comprises a generally major U-shape frame having a horizontal support and a plurality of the vertical supports for receiving a portion of the acoustical panel. The plurality of fasteners including bolts and nuts secure the panel frame of the acoustical panel to the carriage frame.

In another specific example of the invention, the frame comprises a generally minor U-Shape portion for receiving the flexible acoustical blocking material depending from the frame. An adhesive secures the flexible acoustical blocking material within the generally minor U-Shape portion. The generally major U-shape portion is disposed in an upward orientation and the minor U-Shape portion is disposed in a downward orientation. Preferably, the frame is formed by an extrusion process.

A first pair of support legs extends from the first end of the frame and forms an acute angle with the frame. Similarly, a second pair of support legs extends from the second end of the frame and forms an acute angle with the frame. The first pair of support legs extends from the first end of the frame and forms an angle of forty-five degrees with the frame. Similarly, the second pair of support legs extends from the second end of the frame and forms an angle of forty-five degrees with the frame for enabling the carriage to be orientated with a second carriage at an angle of ninety degrees.

A first and a second arm extend from the first and second support legs and are secured to the panel frame of the acoustical panel for stabilizing the acoustical panel on the frame. A first and second plurality of rolling members such as casters are secured to the first and second pair of support legs for enabling the frame to be move along the surface.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 2:
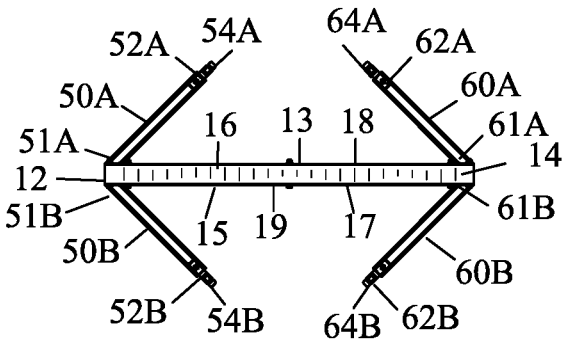
FIG. 2 is a top view of FIG. 1.

FIGS. 1-7 illustrate an improved carrier 5 for moving an acoustical blocking panel 6 on a surface 8. The improved carrier 5 facilitates the movement of large vertical acoustic panels 8 and for arranging a plurality of acoustical panels 6 in an interconnected and interlocking configuration. The improved carrier 5 comprises a frame 20 extending between a first end 21 and a second end 22.

Figure 1:
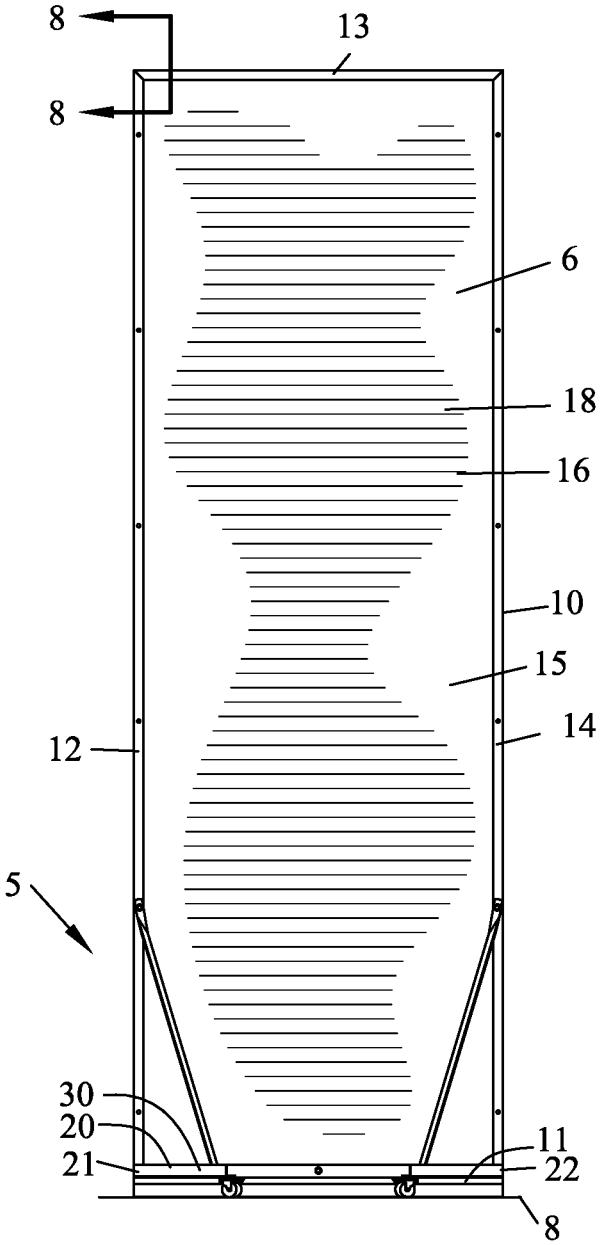
FIG. 1 is a front view of the mobile carriage of the present invention supporting an acoustic panel.
Figure 3:
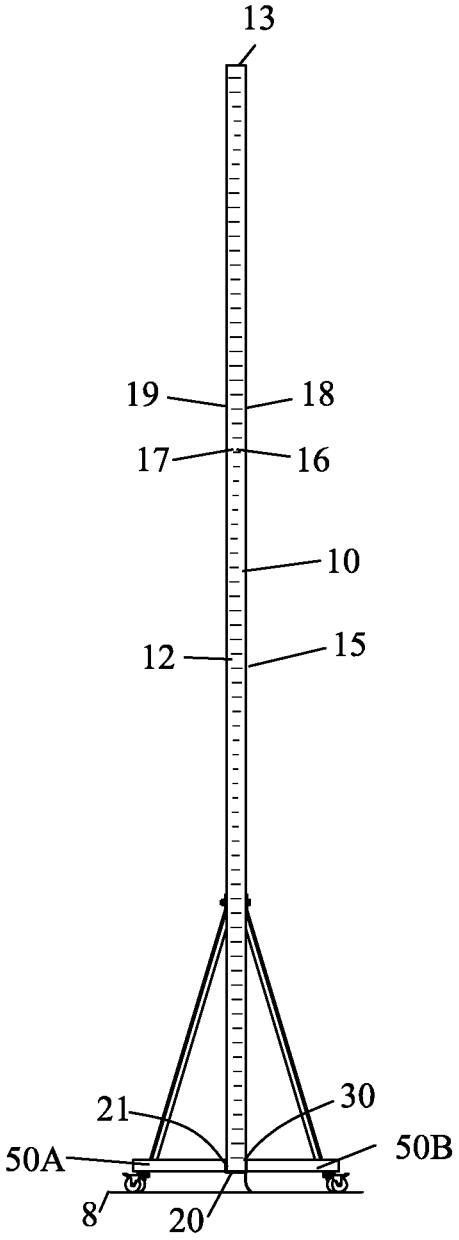
FIG. 3 is a left side view of FIG. 1.
Figure 8:
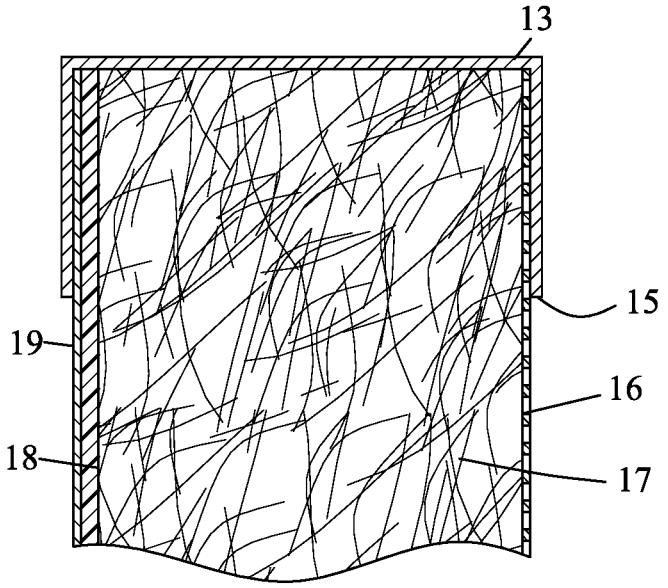
FIG. 8 is a magnified view along line 8-8 in FIG. 1.

FIG. 8 is a magnified sectional view along line 8-8 in FIG. 1 illustrating an example of an acoustical panel 6. The acoustical panel 6 include a peripheral frame 10 defined by first through fourth frame elements 11-14 defining an acoustical aperture 15. The acoustical panel 6 has a sound absorbing member 16 and a sound blocking member 17. Preferably, the sound absorbing member 16 and the sound blocking member 17 are enclosed by a porous screen 18 and a solid sheet 19. A fuller disclosure of a suitable acoustical panel 6 for of use with improved carrier 5 of the present invention are set forth in my prior U.S. Pat. Nos. 7,063,184, 7,503,428, 7,513,082 and 8,739,924 which are incorporated by reference as if fully set forth herein. Although the improved carrier of the present invention has been set forth with reference to a particular type of acoustical panel, it should be understood that the present invention is suitable for us with various types of acoustical panels and non-acoustical panels.

Figure 9:
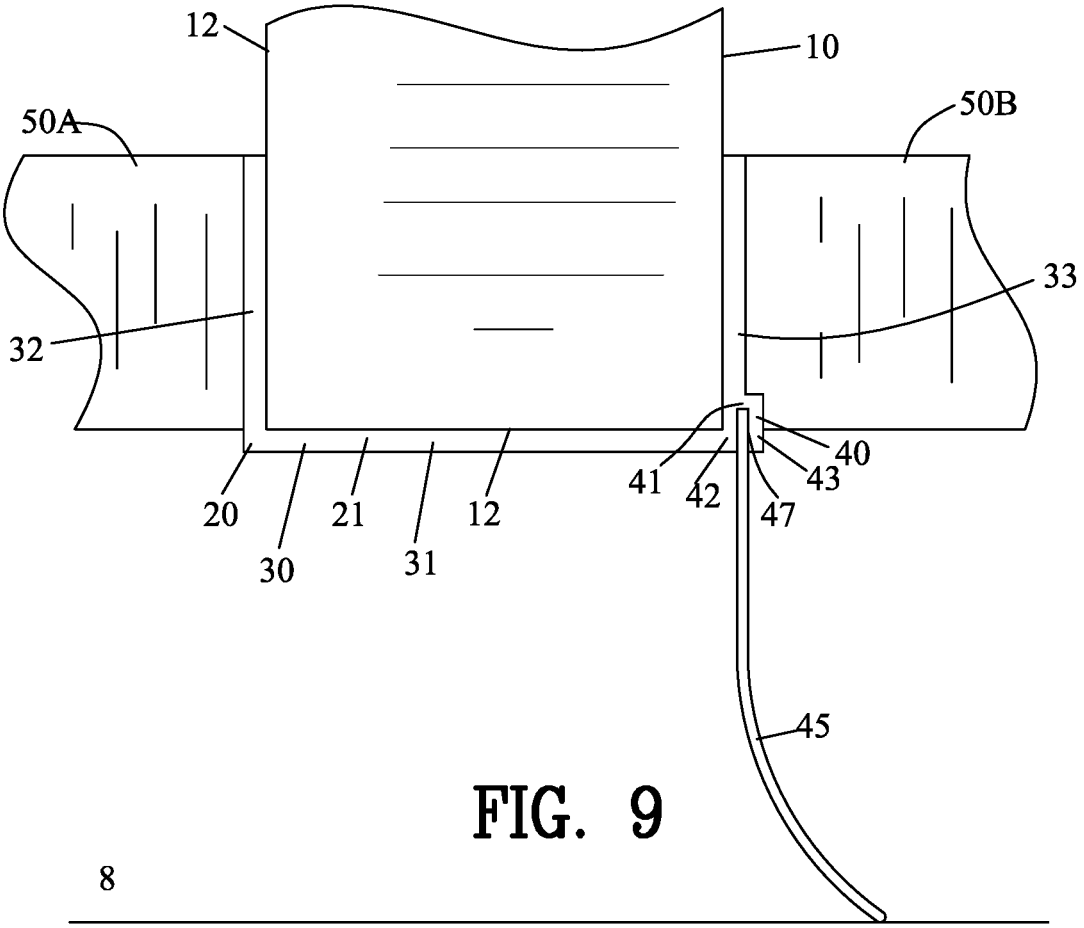
FIG. 9 is a magnified view of a portion of FIG. 6.

FIG. 9 illustrates the frame 20 having a generally U-shaped element 30 formed from a horizontal support 31 and plural vertical supports 32 and 33. The vertical supports 32 and 33 are disposed at opposed ends of the horizontal support 31 thereby defining the generally U-shaped frame element 30.

The generally U-shaped element 30 is upwardly facing and dimensioned to receive the panel frame portion 11 of the panel frame 10 of the acoustical panel 6. The acoustical panel 6 is secure to the frame 20 in a manner to be described hereinafter.

The frame 20 has a generally U-shaped minor element 40 formed from a horizontal component 41 and plural vertical component 42 and 43. The vertical components 42 and 43 are disposed at opposed ends of the horizontal component 41 thereby defining the generally U-shaped frame element 40. The generally U-shaped element 40 is downwardly facing and dimensioned to receive an acoustical blocking material 45 as will be described in greater detail hereinafter. Preferably, the frame is formed by an extrusion process.

Referring back to FIGS. 1-7, a first pair of legs 50 extend from the first end 21 of the frame 20. The first pair of legs 50 comprises a leg 50A and a leg 50B. The leg 50A extends between a proximal end 51A and a distal end 52A. The proximal end 51A is secured to the first end 21 of the frame 20 by suitable means such as conventional fasteners, welding or the like. The leg 50B extends between a proximal end 51B and a distal end 52B. The proximal end 51B is secured to the first end 21 of the frame 20 by suitable means such as conventional fasteners, welding or the like. Preferably, the conventional fasteners are removable fasteners for shipping in a smaller container.

Rolling members 54A and 54B are secured to the distal end 52A and 52B of the legs 50A and 50B for moving the acoustical panel 6 over the surface 8. Preferably, the rolling members 54A and 54B are casters for facilitating movement of the acoustical panel 6 over the surface 8.

A second pair of legs 60 extends from the second end 22 of the frame 20. The second pair of legs 60 comprises a leg 60A and a leg 60B. The leg 60A extends between a proximal end 61A and a distal end 62A. The proximal end 61A is secured to the second end 22 of the frame 20 by suitable means such as conventional fasteners, welding or the like. The leg 60B extends between a proximal end 61B and a distal end 62B. The proximal end 61B is secured to the first end 61 of the frame 20 by suitable means. Rolling members 64A and 64B are secured to the distal end 62A and 62B of the legs 60A and 60B for moving the acoustical panel 6 over the surface 8. Preferably, the rolling members 64A and 64B are casters for facilitating movement of the acoustical panel 6 over the surface 8.

Figure 5:
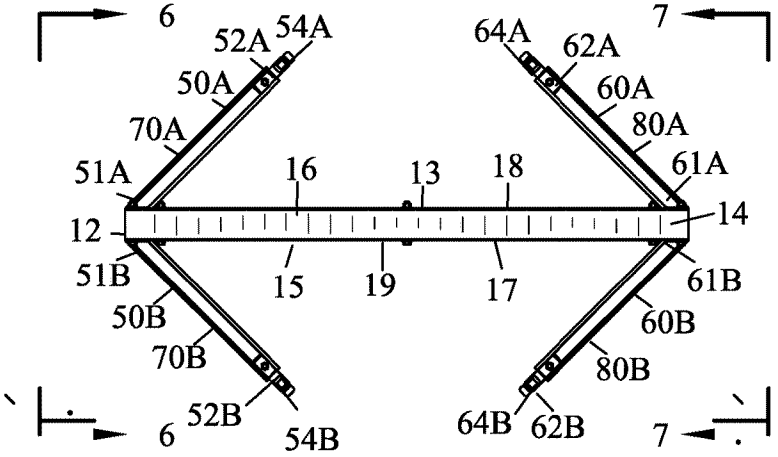
FIG. 5 is a top view of FIG. 4.
Figure 4:
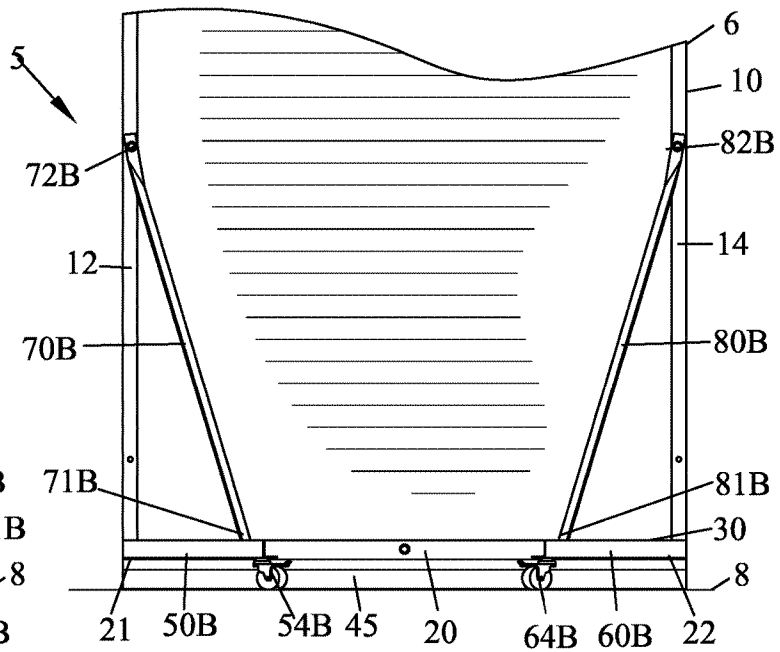
FIG. 4 is a enlarged view of a portion of FIG. 1.
Figure 6:
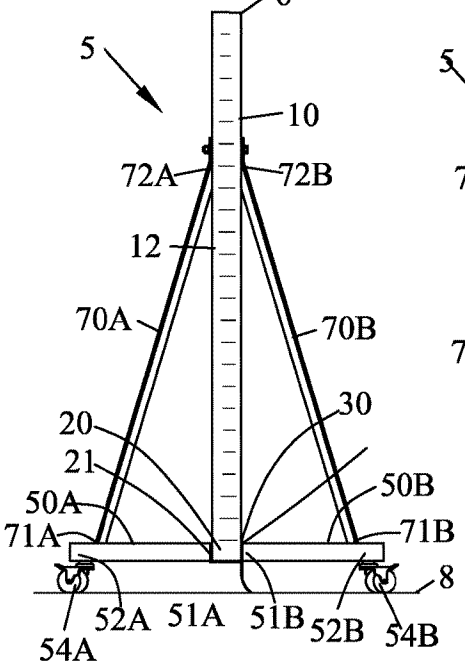
FIG. 6 is a view along line 6-6 in FIG. 5.
Figure 7:
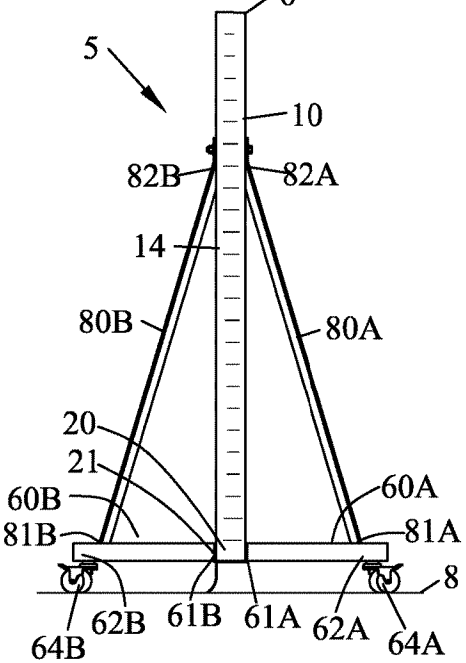
FIG. 7 is a view along line 7-7 in FIG. 5.

As best shown in FIG. 5, the first pair of the support legs 50 extends from the first end 21 of the frame 20 to form an angle of forty-five degrees with said frame 20. The distal ends 52A and 52B of the support legs 50A and 50B extend from the first end 21 of the frame 20 in a direction generally toward the second end 22 of the frame 20.

The second pair of support legs 60 extends from said second end 22 of the frame 20 to form an angle of forty-five degrees with said frame 20. The distal ends 62A and 62B of the support legs 60A and 60B extend from the second end 22 of the frame 20 in a direction generally toward the first end 21 of the frame 20.

A first and second pair of arms 70 and 80 provides support and stabilizes the acoustic panel 6. The first pair of arms 70 comprise arms 70A and 70B is located at the first end 21 of the frame 20 whereas the second pair of arms 80 comprise arms 80A and 80B is located at the second end 21 of the frame 20.

The arm 70A extends between a lower end 71A and an upper end 72A. The lower end 71A is secured to the distal end of the leg 52A by suitable means such as conventional fasteners. The upper end 72A is secured to the second frame elements 12 of the peripheral frame 10 of the acoustical panel 6. The arm 70B extends between a lower end 71B and an upper end 72B. The lower end 71B is secured to the distal end of the leg 52B by suitable means such as conventional fasteners. The upper end 72B is secured to the second frame elements 12 of the peripheral frame 10 of the acoustical panel 6.

The arm 80A extends between a lower end 81A and an upper end 82A. The lower end 81A is secured to the distal end of the leg 60A by suitable means such as conventional fasteners. The upper end 82A is secured to the fourth frame elements 14 of the peripheral frame 10 of the acoustical panel 6. The arm 80B extends between a lower end 81B and an upper end 82B. The lower end 81B is secured to the distal end of the leg 60B by suitable means such as conventional fasteners. The upper end 82B is secured to the fourth frame elements 14 of the peripheral frame 10 of the acoustical panel 6.

Referring back to FIGS. 6 and 9, the rolling members 54A, 54B, 64A and 64B elevate the frame above the surface 8. The sheet of the acoustical blocking material 45 between the frame 20 and the surface 8 inhibits acoustical energy from passing under the improved carrier 5.

The generally U-shaped minor element 40 formed in the frame 20 receives a sheet of the acoustical blocking material 45. The sheet of the acoustical blocking material 45 is retained within the U-shaped minor element 40 by suitable means such as friction, adhesives or the like. Preferably, the sheet of the acoustical blocking material 45 is longer than the distance between the frame 20 and the surface 8 for insuring constant contact of the sheet of the acoustical blocking material 45 with the surface 8.

Figure 11:
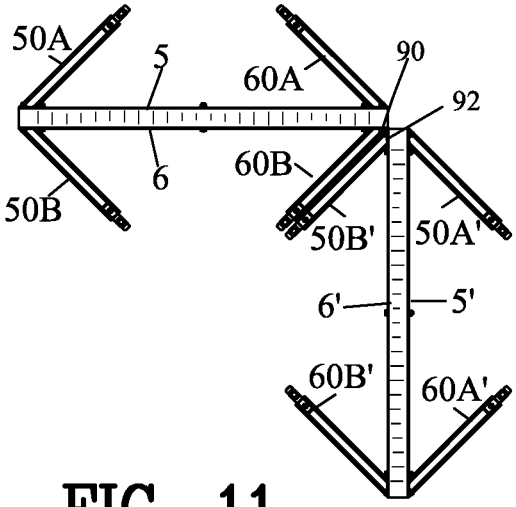
FIG. 11 is a top view of FIG. 10.
Figure 10:
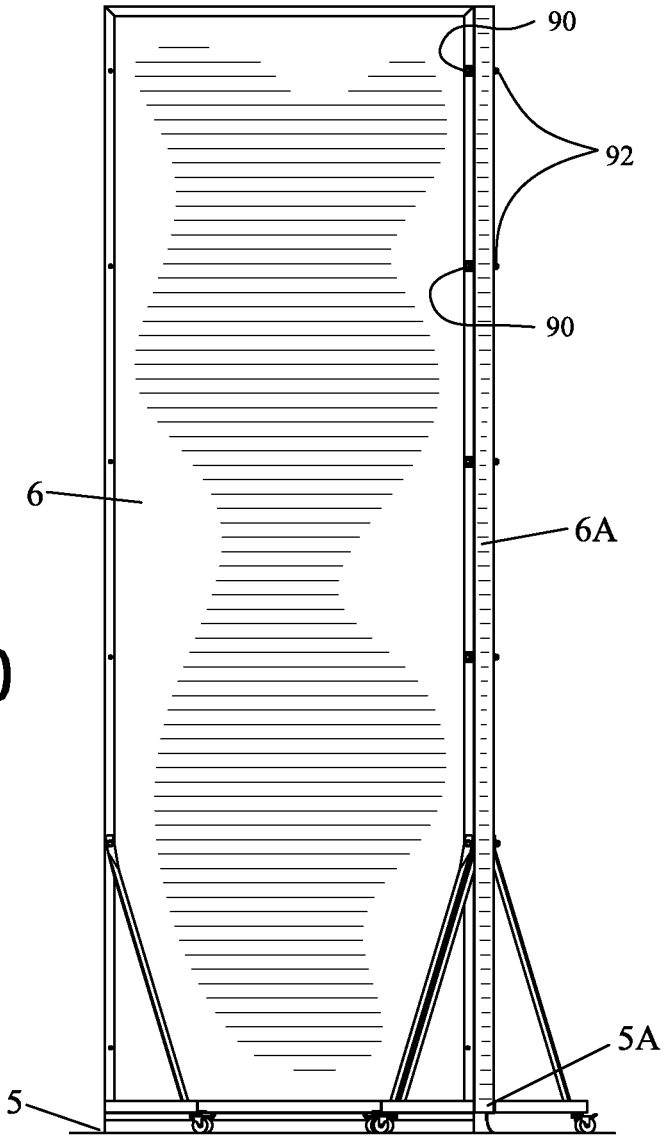
FIG. 10 is a front view illustrating two adjacent mobile carriages interlocking two acoustic panels at an angle of ninety degrees.

FIGS. 10-11 illustrating two adjacent mobile carriages 5 and 5' interlocking two acoustic panels 6 and 6' at an angle of ninety degrees. The forty-five (45°) degree angle of the support legs 50A, 50B, 60A and 60B enable the two adjacent mobile carriages 5 and 5' to be orientated an angle of ninety degrees.

Figure 12:
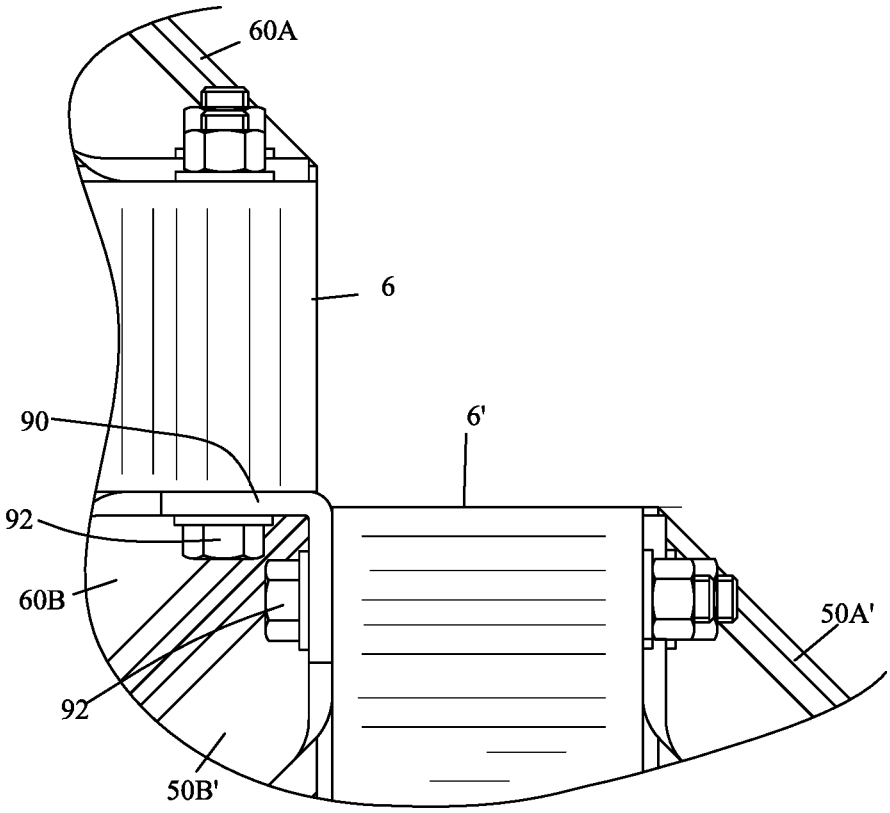
FIG. 12 is a magnified top view of a portion of FIG. 11 illustrating a connector for interlocking two adjacent acoustic panels.
Figure 13:
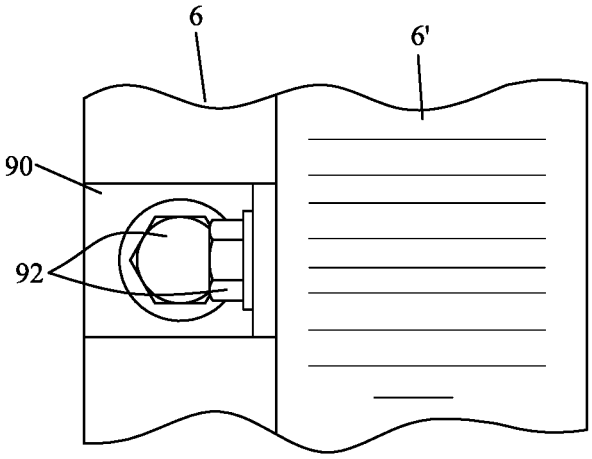
FIG. 13 is a front view of FIG. 12.

FIGS. 12 and 13 illustrate a connector suitable for interlocking the two adjacent acoustic panels 6 and 6'. In this example, a corner coupling 90 is secured to the adjacent acoustic panels 6 and 6' by fasteners 92 shown as bolts. It should be appreciated by those skilled in the art that various types of connectors are suitable for interlocking the two adjacent acoustic panels 6 and 6'

Figure 15:
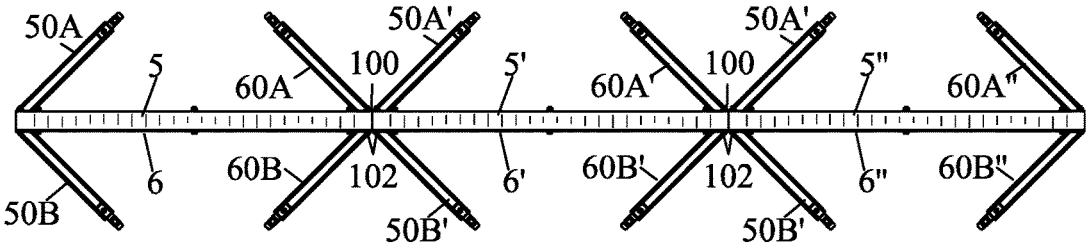
FIG. 15 is a top view of FIG. 14.
Figure 14:
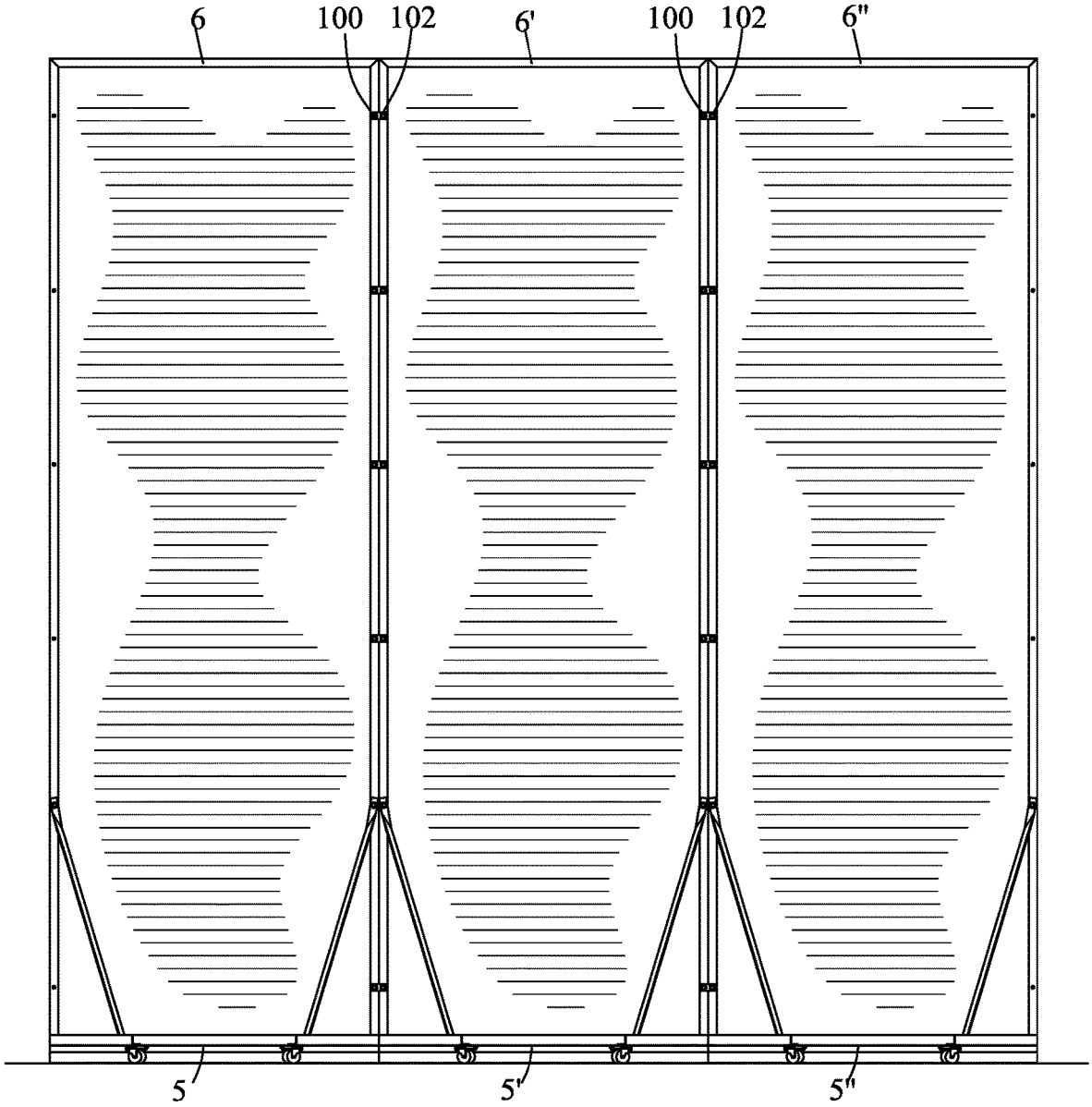
FIG. 14 illustrates three adjacent mobile carriages interlocking three acoustic panels in a linear orientation.

FIGS. 14 and 15 illustrate three adjacent mobile carriages 5, 5' and 5" interlocking three acoustic panels 6, 6' and 6" in a linear orientation. The forty-five (45°) degree angle of the support legs 50A, 50B, 60A and 60B enable the two adjacent mobile carriages 5 and 5' to be orientated in a linear orientation.

Figure 16:
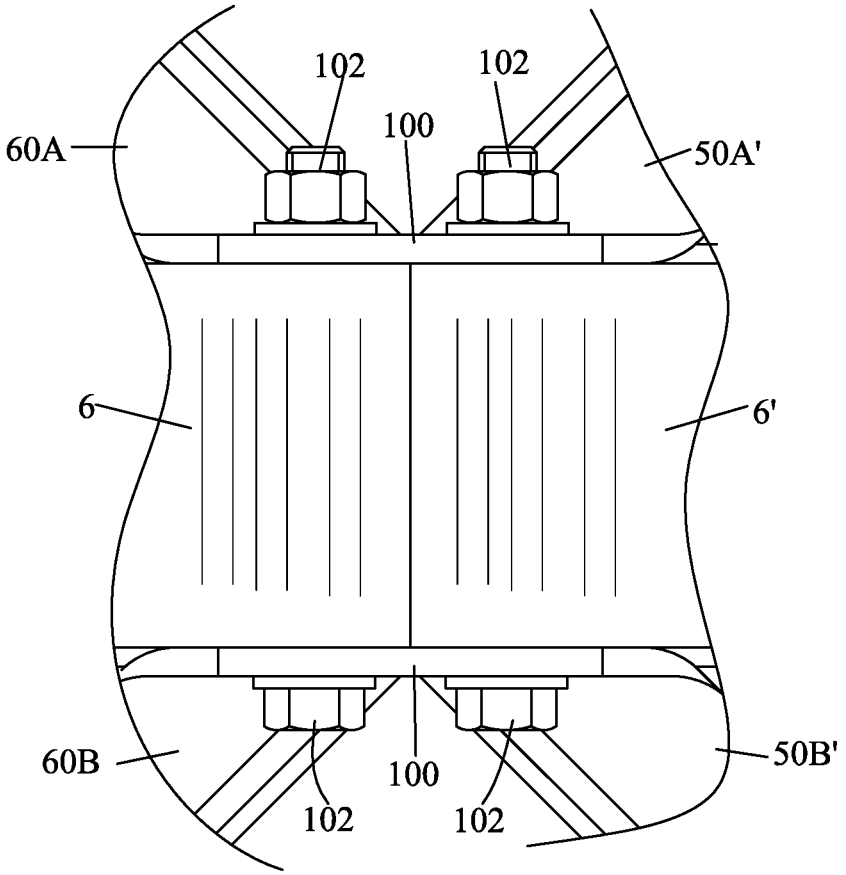
FIG. 16 is a magnified top view of a portion of FIG. 15 illustrating a connector for interlocking two adjacent acoustic panels.
Figure 17:
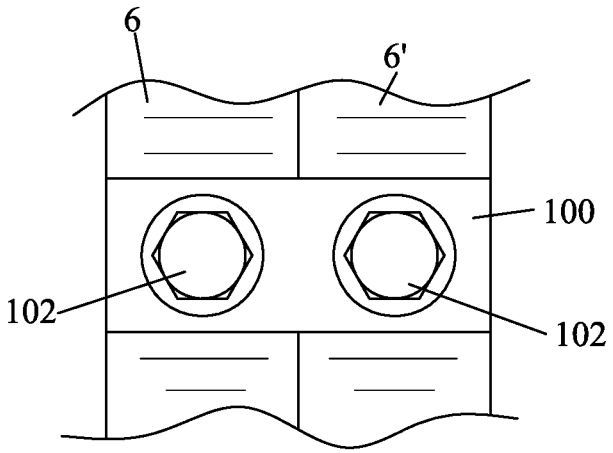
FIG. 17 is a front view of FIG. 16.

FIGS. 16 and 17 illustrate a connector suitable for interlocking the two adjacent acoustic panels 6 and 6'. In this example, a linear coupling 100 is secured to the adjacent acoustic panels 6 and 6' by fasteners 102 shown as bolts. It should be appreciated by those skilled in the art that various types of connectors are suitable for interlocking the two adjacent acoustic panels 6 and 6'

Although the support legs 50A, 50B, 60A and 60B have been shown to be orientated an angle of forty-five (45°) degrees relative to the frame 20, it should appreciated by those skilled in the art that the support legs 50A, 50B, 60A and 60B may be orientated at different angles other than forty-five (45°) degrees. Different angles will produce acoustical barriers in the shape of pentagon, octagons, and the like.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A carriage for moveably supporting an acoustical panel on a surface, the acoustical panel having a panel frame extending about the acoustical panel for defining an acoustical aperture to receive and dissipate acoustical energy, the carriage comprising:

a frame having a horizontal support extending between a first and a second end and a vertical support;

a first and a second pair of support legs extending angularly from said frame for enabling a plurality of carriages to orientate acoustical panels in a linear or angular relationship;

a first and second plurality of rolling members secured to said first and second pair of support legs for enabling said frame to be moved along the surface;

a plurality of fasteners securing said panel frame of said acoustical panel to said frame;

and a flexible acoustical blocking material depending from said frame for occupying the gap between said frame and the surface.

2. A carriage for moveably supporting an acoustical panel as set forth in claim 1, wherein said first pair of support legs extend from a first end of said frame and form an angle of forty-five degrees with said frame; and said second pair of support legs extend from a second end of said frame and form an angle of forty-five degrees with said frame for enabling said carriage to be orientated with a second carriage at an angle of ninety degrees.

3. A carriage for moveably supporting an acoustical panel on a surface, the acoustical panel having a panel frame extending about a perimeter of the acoustical panel for defining an acoustical aperture to receive and dissipate acoustical energy, the carriage comprising:

a frame having a horizontal support and a vertical support extending between a first and a second end of said frame;

a first pair of support legs extending from said first end of said frame and forming an acute angle with said frame;

a second pair of support legs extending from said second end of said frame and forming an acute angle with said frame;

a first and second plurality of rolling members secure to said first and second pair of support legs for enabling said frame to be moved along the surface;

said horizontal support and said vertical support receiving a portion of the panel frame of said acoustical panel;

a plurality of fasteners securing said panel frame of said acoustical panel to said frame;

a first and a second arm extending from said first and second support legs and secured to the panel frame of said acoustical panel for stabilizing the acoustical panel on said frame; and a flexible acoustical blocking material depending from said frame for occupying the gap between said frame and the surface.

4. A carriage for moveably supporting an acoustical panel as set forth in claim 3, wherein said frame comprises a generally major U-shape frame having said horizontal support and a plurality of said vertical supports.

5. A carriage for moveably supporting an acoustical panel as set forth in claim 3, wherein said frame comprises a generally major U-shape frame having said horizontal support and a plurality of said vertical supports for receiving the portion of the acoustical panel; and said plurality of fasteners securing said panel frame of said acoustical panel to said plurality vertical supports of said frame.

6. A carriage for moveably supporting an acoustical panel as set forth in claim 3, wherein said frame comprises a generally minor U-Shape portion for receiving said flexible acoustical blocking material depending from said frame.

7. A carriage for moveably supporting an acoustical panel as set forth in claim 3, wherein said frame comprises a generally minor U-Shape portion for receiving said flexible acoustical blocking material depending from said frame; and an adhesive for securing said flexible acoustical blocking material within said generally minor U-Shape portion.

8. A carriage for moveably supporting an acoustical panel as set forth in claim 3, wherein said frame comprises a generally major U-shape frame having said horizontal support and a plurality of said vertical supports for receiving the portion of the acoustical panel;

said frame comprises a generally minor U-Shape portion for receiving said flexible acoustical blocking material depending from said frame; and said generally major U-shape portion disposed in an upward orientation and said minor U-Shape portion is disposed in a downward orientation.

9. A carriage for moveably supporting an acoustical panel as set forth in claim 3, wherein said frame is formed by an extrusion process.

10. A carriage for moveably supporting an acoustical panel as set forth in claim 3, wherein said plurality of fasteners include bolts and nuts for securing said panel frame of said acoustical panel to said frame.

11. A carriage for moveably supporting an acoustical panel as set forth in claim 3, wherein said first pair of support legs extend from said first end of said frame and form an angle of forty-five degrees with said frame; and said second pair of support legs extend from said second end of said frame and form an angle of forty-five degrees with said frame for enabling said carriage to be orientated with a second carriage at an angle of ninety degrees.

12. A carriage for moveably supporting an acoustical panel as set forth in claim 3, wherein said first pair of support legs extend from said first end of said frame toward said second end of said frame and form an angle of forty-five degrees with said frame; and said second pair of support legs extend from said second end of said frame toward said first end of said frame and form an angle of forty-five degrees with said frame.

13. A carriage for moveably supporting an acoustical panel as set forth in claim 3, wherein said first arm comprises a pair of first arms extending from said first pair of support legs, respectively; and said second arm comprises a pair of second arms extending from said second pair of support legs, respectively.

14. A carriage for moveably supporting an acoustical panel as set forth in claim 3, wherein said first and second plurality of rolling members include casters secured to said first and second pair of support legs for enabling said frame to be move along the surface.

* * * * *